United States Patent [19]

Dearlove et al.

[11] 4,089,439

[45] May 16, 1978

[54] APPARATUS FOR DISCHARGING FIBERS FROM BETWEEN THE CONVOLUTIONS OF A COILED WEB

[75] Inventors: William E. Dearlove, Washington; Frederick S. Engelking, Peoria, both of Ill.

[73] Assignee: Caterpillar Tractor Co., Peoria, Ill.

[21] Appl. No.: 766,188

[22] Filed: Feb. 7, 1977

Related U.S. Application Data

[62] Division of Ser. No. 595,073, Jul. 11, 1975, Pat. No. 4,023,706.

[51] Int. Cl.[2] ..... B65B 9/00; E04C 5/01

[52] U.S. Cl. ..... 222/167; 53/118; 198/750; 206/388

[58] Field of Search ..... 221/25, 26, 27, 28, 221/70, 71, 72, 73, 74; 222/167; 53/118; 198/750; 206/312, 390, 417, 388

[56] References Cited

U.S. PATENT DOCUMENTS

| | | | |
|---|---|---|---|
| 819,542 | 5/1906 | Hague | 198/750 |
| 2,139,886 | 12/1938 | Drachenberg | 221/72 X |
| 2,681,702 | 6/1954 | Kuenn et al. | 53/118 X |
| 2,804,972 | 9/1957 | Anderson | 206/388 |

FOREIGN PATENT DOCUMENTS

| | | | |
|---|---|---|---|
| 806,952 | 1/1959 | United Kingdom | 221/70 |
| 390,541 | 12/1973 | U.S.S.R. | 221/72 |

*Primary Examiner*—Robert B. Reeves
*Assistant Examiner*—David A. Scherbel
*Attorney, Agent, or Firm*—Wegner, Stellman, McCord, Wiles & Wood

[57] ABSTRACT

An apparatus for dispensing fibers for use in the making of fibrous concrete is disclosed in which the fibers are dispensed from an elongated web which has been coiled with the fibers placed within the layers of the coils. The individual concrete reinforcing fibers are deposited in a uniform layer on an elongated web, which is then coiled to form a package. The dispensing device supports a spindle on which the coiled package is placed. The end of the coil of the package is wound around a second spindle which is driven by a rotary motor, and as the web is progressively uncoiled and wound around this second spindle, the fibers are discharged from between the convolutions of the coil.

6 Claims, 5 Drawing Figures

APPARATUS FOR DISCHARGING FIBERS FROM BETWEEN THE CONVOLUTIONS OF A COILED WEB

This is a division of application Ser. No. 595,073 filed July 11, 1975 now U.S. Pat. No. 4,023,706.

BACKGROUND OF THE INVENTION

This invention relates to fiber reinforced concrete, and, more specifically, to a method of mixing fiber reinforced concrete without the formation of fiber balls therein and to a package designed for use with the method.

The desirability of employing fibrous reinforcing material in concrete has been known for a number of years. In many instances, the use of fiber reinforcing material eliminates the need for reinforcing rods in that fiber reinforced concrete can have the strength of rod reinforced concrete and can be formed at lesser cost. Where the concrete is used in roadways or the like, the presence of the fibers at the exposed surface to the roadway also provides improved wear resistance.

One perplexing difficulty that has stymied extensive use of fiber reinforced concrete is the tendency of the fibers to adhere to each other and form balls which are not fully wetted by the concrete mix itself. As a result, there is a poor concrete to fiber bond and a corresponding decrease in strength. Moreover, where the balls are of significant size, a partial void results to form a flaw or weak spot.

One solution to the problem is the use of specially designed fiber feeders for separating fiber balls found in a package of fibers and slowly feeding individual fibers into a mixer or the like. One type of feeder of the type mentioned is obtainable from the National Concrete Machinery Company Division of Irl Daffin Associates.

Such a feeder works well for its intended purpose, but is large, cumbersome and expensive. As a consequence, it does not readily lend itself to use with small concrete mixing systems. Moreover, the cost of such a feeder can discourage its use in large concrete mixing systems.

SUMMARY OF THE INVENTION

It is the principal object of the invention to provide a new and improved method and means whereby substantially individual fibers may be uniformly fed into a concrete mixing device to eliminate balling of the fibers in the resultant concrete mix.

The invention achieves the foregoing object in a method including the steps of depositing a uniform layer of substantially individual concrete reinforcing fibers on an elongated web. The web is then coiled so as to contain the fibers. The coiled, fiber-containing web is then located in proximity to a concrete mixing device and is progressively uncoiled at a predetermined rate to discharge the layer of fibers therefrom thereby progressively depositing the fibers in the mixing device.

In a highly preferred embodiment of the invention, the step of uncoiling the web is accompanied by the step of recoiling the web at a location below the coiled, fiber-containing web, in a direction opposite from the coiling of the web according to the first step of the method.

Similarly, a highly preferred embodiment of the invention contemplates that the step of depositing the fibers on the web be performed by cutting fibers above the web to insure their deposition as a uniform layer of individual fibers.

The object of the invention is also achieved in a unique packaging structure for the concrete reinforcing fibers, which package structure is particularly suited for use in connection with the above described method. The package comprises a spirally wound elongated web of flexible material having a uniform layer of reinforcing fibers disposed between the convolutions of the web and contained thereby. The fibers are unattached to the web.

Preferably, a support device is located generally concentrically with the spiral axis of the web and may be in the form of a spindle or a reel or the like.

In general, the invention contemplates the use of steel fibers having a length on the order of one to three inches.

The invention also contemplates provision of apparatus for dispensing apparatus for a package of the type set forth above. The apparatus includes a pair of spaced frame members, each having means for rotatably and removably receiving the spindle of the package and adapted to be located over a means for receiving the fibers. Means are provided for rotating a spindle received in the spindle receiving means and include an easily releasable rotary drive connection for connection to the spindle. A web takeup shaft is journalled by the frame members below the receiving means and means are provided for rotating the takeup shaft.

According to a highly preferred embodiment of the invention, a conveyor for concrete ingredients extends between the frame members below the takeup shaft. In addition, a single prime mover is employed for rotating both the spindle and the takeup shaft. Means are provided for applying substantially constant torque to the takeup shaft.

A speed control device is employed for the prime mover so that the rate at which fibers are dispensed may be selectively controlled and the spindle receiving means are constructed and arranged to permit the spindle to be axially shifted relative to the frame members to engage the spindle with the drive connection.

Other objects and advantages will become apparent from the following specification taken in connection with the accompanying drawings.

DESCRIPTION OF THE PREFERRED EMBODIMENT

Figure 1:
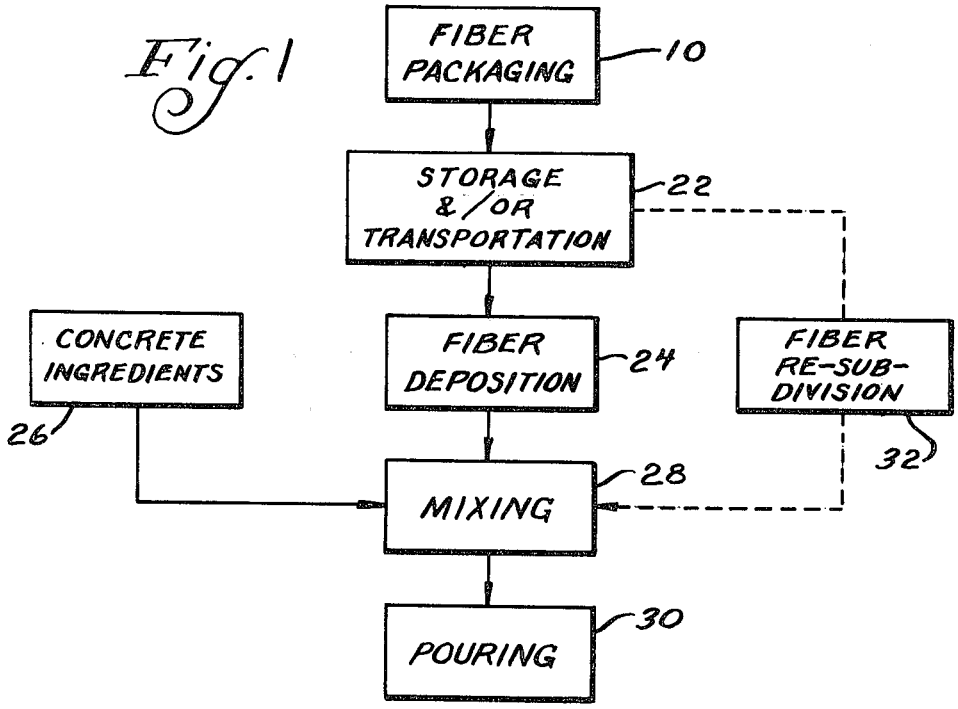
FIG. 1 is a flow diagram of the method of the present invention.

The inventive method and package are illustrated in the accompanying drawings and with reference to the method specifically, as seen in FIG. 1, the first step thereof is designated 10 and comprises the step of packaging concrete reinforcing fiber. Generally, although not always, the fiber employed will be steel fiber having a length in the range of one to three inches. Frequently, the fibers will have a noncircular cross section to increase their surface area and thereby improve their ability to bond with concrete.

Figure 2:
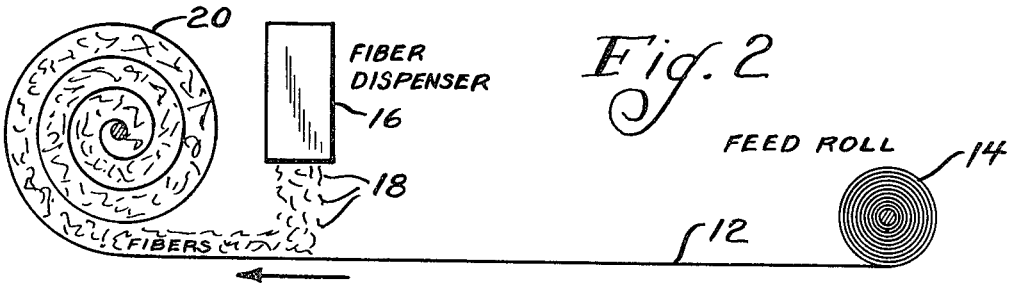
FIG. 2 is a somewhat schematic illustration of the performance of initial steps of the inventive method and illustrating the unique package of the invention.

With reference to FIG. 2, the step of fiber packaging is accomplished as follows. An elongated web of flexible material 12 may be coiled as a feed roll 14. The web 12 is uncoiled from the feed roll 14 and moved progressively under a fiber dispenser 16 which dispenses fibers 18 onto the upper surface of the web in a uniform layer of substantially individual fibers. The dispenser 16 may be a wire chopper or a cutter for cutting a strip into square or rectangular cross-sectional fibers.

According to a highly preferred embodiment of the invention, the fiber dispenser 16 is a cutting device for cutting long lengths of fibers to a length, generally in the aforementioned range. When such a cutting device is employed as the fiber dispenser 16, deposition of the layer of fibers on the web 12 as substantially individual fibers is assured.

After the fibers 18 have been deposited on the web as a uniform layer of substantially individual fibers, the web 12 is coiled to form a package 20 of the fibers. The package 20 is formed by spirally winding the web 12 with the uniform layer of reinforcing fibers disposed between the convolutions of the web to be contained thereby. No effort is made to attach the fibers to the web and, in fact, none should be made, as will become more apparent hereinafter.

The material of which the web 12 is formed forms no part of the instant invention, it being largely dependent upon the size of the package 12 to be formed, the thickness of the layer of fibers 18 deposited on the web 12, and to some extent, the length of the fibers deposited on the web 12.

Similarly, the thickness of the layer of fibers deposited on the web will be dependent upon the length and type of the fibers employed. Generally, the thickness will be determined by the number of fibers of the type and thickness of concern that can fall from the web and mix homogeneously without balling.

Returning to FIG. 1, the package 20 formed as illustrated in FIG. 2 may be stored and/or transported to the consumer as indicated by a block 22. Ultimately, the package 20 will be located in proximity to a concrete mixer for fiber deposition therein as indicated by a block 24. At the concrete mixing system, concrete ingredients are added to a mixer, indicated schematically at blocks 26 and 28, respectively, to form a mix of fiber reinforced concrete. The concrete may then be poured as illustrated by box 30 in a conventional fashion.

Optionally, fiber resubdivision, indicated by a block 32, may be performed at the time of fiber deposition.

Figure 3:
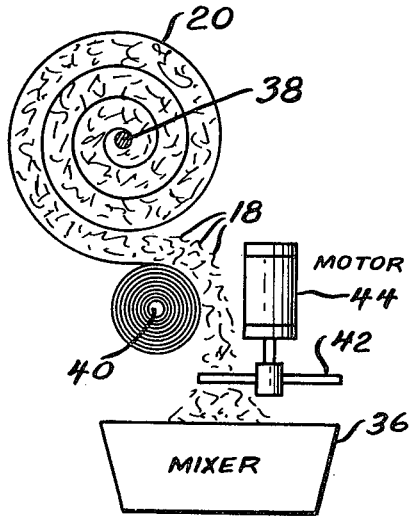
FIG. 3 is a somewhat schematic illustration of the latter steps of the method and also illustrates the unique package of the invention.

Turning now to FIG. 3, the step of fiber deposition is illustrated in greater detail. As mentioned previously, the package 20 is located in proximity to a mixer 36. As illustrated in FIG. 3, the mixer 36 is upwardly open and, accordingly, the package 20 will be located above the mixer on a suitable spindle 38 or the like. As an alternate to the spindle 38, any other supporting structure for the package 20 may be employed, provided, however, that such supporting structure be generally concentric with the spiral axis of the package 20 so as to facilitate mounting the package 20 for rotation.

The outermost end of the web 12 may be secured to a driven spindle 40 which may be rotated by any suitable means, not shown, at a controlled rate. It is desired that the spindle 40 recoil the web 12 in a direction opposite from its original coiling to form the package as illustrated in FIG. 3. As a consequence, uncoiling of the package 20 and recoiling of the web 12 by the spindle 40 will result in the uniform layer of fibers 18 being progressively deposited in the mixer 36 under the influence of gravity. If desired, the optional step of resubdivision may be performed at this time through the use of a beater structure having plural fingers 42 rotated by a motor 44 so as to move the fingers 42 through the path of descent of the fibers 18. Fibers having adhered to each other will be struck by the fingers 42 and disentangled to preclude the formation of balls in the concrete mix.

In general, at the time of fiber deposition, the concrete ingredients will already have been mixed so that upon addition of the fibers, they will be uniformly added to the concrete ingredients.

Figure 4:
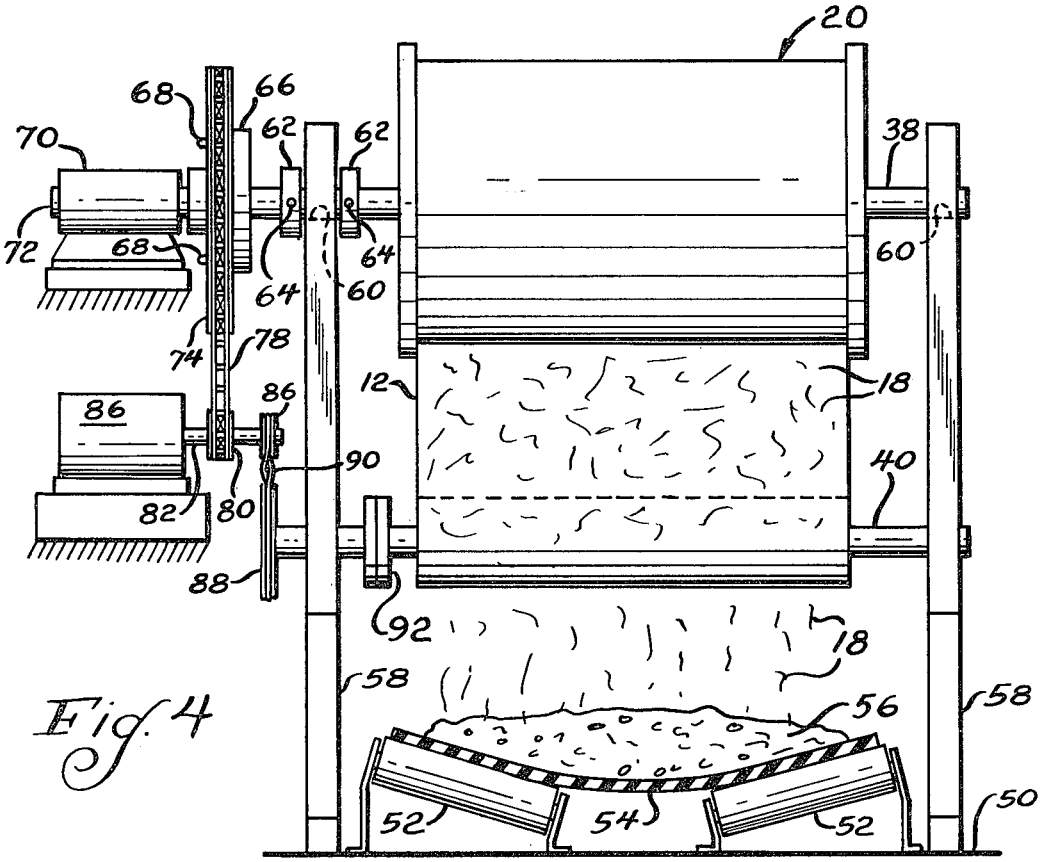
FIG. 4 is an elevation of an apparatus made according to the invention for dispensing fibers from the package.
Figure 5:
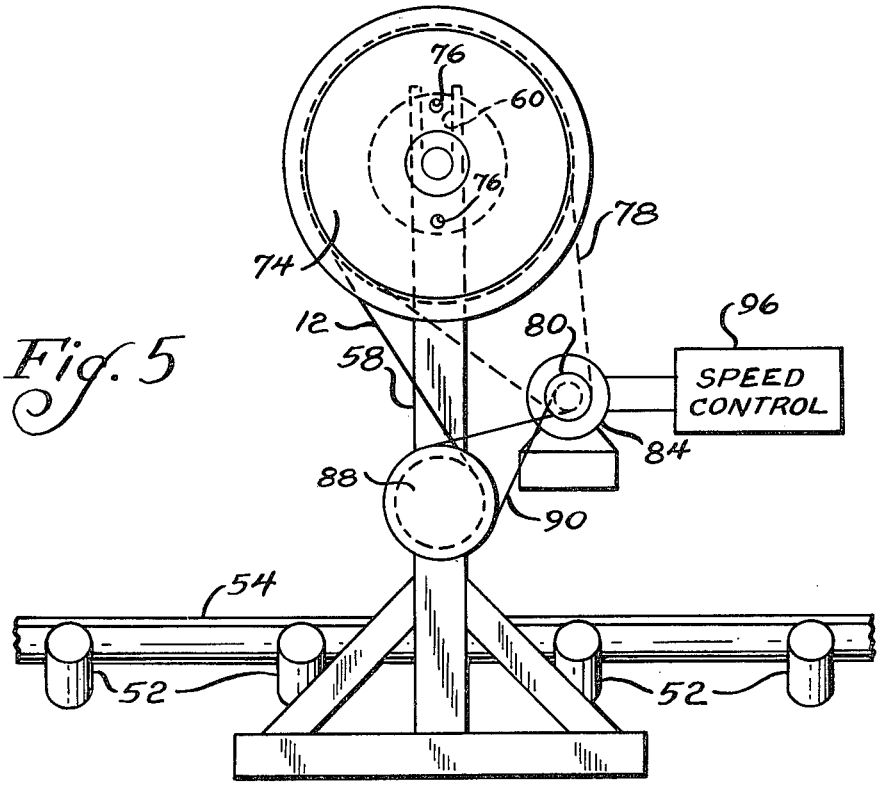
FIG. 5 is a side elevation of the apparatus.

FIGS. 4 and 5 illustrate a preferred embodiment of an apparatus for dispensing fibers from the package 20 in a uniform manner to be added to the concrete ingredients.

A base surface 50 mounts sets of angulated rollers 52 which, in turn, support a conveyor belt 54. Concrete ingredients 56 are deposited on the belt 54 by any suitable means to be conveyed to a mixer. At the time of deposition of the ingredients 56 on the belt 54, the ingredients 56 are mixed and/or deposited uniformly in their proper proportions.

Spaced upright frame members 58 are disposed on opposite sides of the belt 54. As best seen in FIG. 5, the upper end of each of the frame members 58 includes an upwardly open notch 60 for receipt of the spindle 38 of a package 20 whereby the spindle 38 is removably received, is journalled, and may be moved axially.

When used with the apparatus illustrated in FIGS. 4 and 5, the spindle 38, adjacent one end thereof, is provided with adjustable collars 62 which may be secured to the spindle 38 against rotation, or loosened by means of set screws 64. One end of the spindle 38 is provided with a disc 66 provided with a pair of axially projecting pins 68.

Any suitable support mounts a bearing 70 adjacent the end of the spindle 38 bearing the disc 66. The bearing 70 journals a shaft 72 which, in turn, mounts a sprocket 74 for rotation about an axis coaxial with the axis of the spindle 38 when disposed in the groove 60. The sprocket 74 includes apertures 76 for receipt of the pins 68 carried by the disc 66 on the spindle 38. Thus, when the pins 68 are received in the apertures 76, a driving connection between the sprocket 74 and the spindle 38 is established. On the other hand, the driving connection may be readily released simply by shifting the spindle 38 axially to the right as illustrated in FIG. 4.

When the driving connection is to be established, the collars 62 are loosened and the spindle 38 axially shifted such that the pins 68 enter the apertures 76. The collars 62 may then be located in the position illustrated in FIG. 4 and tightened to maintain the driving connection. When the spindle 38 is to be removed upon exhaustion of the supply of fibers in the package 20, the collars 62 are loosened and the foregoing operation reversed.

The sprocket 74 is driven by a chain 78 which, in turn, is driven by a sprocket 80 on the output shaft 82 of a motor 84 suitably mounted by an appropriate base. The output shaft 82 also mounts a sheave 86 in alignment with the sheave 88 carried by the web takeup shaft 40 which is journalled between the frame members 58. A cross belt 90 establishes a driving connection between the sheaves 86 and 88 in such a way that, upon energization of motor 84, both the spindle 38 and the takeup shaft 40 will be rotated, but in opposite directions.

Preferably, a slip clutch 92 is interposed in the drive for the shaft 40 so that constant torque will be applied to the shaft 40 for all diameters of the web on the takeup shaft 40 during the dispensing process.

Finally, as illustrated in FIG. 5, the motor 84 is provided with a conventional speed control system 96 so that the dispensing rate can be selectively varied as desired.

From the foregoing, it will be appreciated that the invention achieves the foregoing objects in providing for the uniform deposition of substantially individual concrete reinforcing fibers in a concrete mixer. Significantly, only extremely simple apparatus is required, which apparatus can be constructed quite economically in comparison to feeders heretofore employed for the purpose. Moreover, through the unique package employed in the method, the packaging of fibers may be readily accomplished shortly after their formation at a plant or the like and the package then employed as part of the method of the invention.

We claim:

1. Apparatus for dispensing fibers for use in the making of fibrous concrete comprising:

a package of concrete reinforcing fibers comprising a spirally wound, elongated web of flexible material and a uniform layer of reinforcing fibers disposed between the convolutions of the web and contained thereby, said fibers being unattached to said web;

a support device located generally concentric with the spiral axis of said web and comprising a spindle mounting said web;

a pair of spaced frame members each having means rotatably and removably receiving the spindle of the package and adapted to be located over a means for receiving the fibers;

means for rotating a spindle received in said receiving means, including an easily releasable rotary drive connection for connection to the spindle;

a web takeup shaft journalled by said frame members below said receiving means; and means for rotating said takeup shaft.

2. The apparatus of claim 1 further including a conveyor for concrete ingredients extending between said frame members below said takeup shaft.

3. The apparatus of claim 1 wherein a single prime mover is employed for rotating both said spindle and said takeup shaft, said takeup shaft rotating means including means for applying substantially constant torque to said takeup shaft operatively interposed between said prime mover and said takeup shaft.

4. The apparatus of claim 3 further including a speed control device for said prime mover.

5. The apparatus of claim 1 wherein said spindle receiving means are constructed and arranged to permit said spindle to be axially shifted relative to said frame members to engage said spindle with said drive connection.

6. The apparatus of claim 1 further including a concrete mixer disposed in proximity to said apparatus to receive fibers from said coiled web.

* * * * *